US005163388A

United States Patent [19]

Jonsson

[11] Patent Number: 5,163,388

[45] Date of Patent: Nov. 17, 1992

[54] TWO-STROKE I.C. ENGINE WITH A SUPER CHARGER

[75] Inventor: Bo. I. R. Jonsson, Huskvarna, Sweden

[73] Assignee: Aktiebolaget Electrolux, Stockholm, Sweden

[21] Appl. No.: 778,782

[22] Filed: Oct. 18, 1991

[30] Foreign Application Priority Data

Nov. 6, 1990 [SE] Sweden ..... 9003530

[51] Int. Cl.[5] ..... F02M 35/00

[52] U.S. Cl. ..... 123/65 BA; 123/73 S

[58] Field of Search ..... 123/65 R, 65 A, 65 BA, 123/65 W, 65 V, 73 A, 73 S

[56] References Cited

U.S. PATENT DOCUMENTS

| | | | |
|---|---|---|---|
| 2,140,503 | 12/1938 | Beckman | 123/65 BA |
| 2,987,055 | 6/1961 | Grauel et al. | 123/65 BA |
| 3,104,656 | 9/1963 | Landrum | 123/73 S |
| 3,680,305 | 8/1972 | Miller | 123/65 BA |
| 4,236,490 | 12/1980 | Correll | 123/65 A |
| 4,248,185 | 2/1981 | Jaulmes | 123/65 A |

FOREIGN PATENT DOCUMENTS

| | | | |
|---|---|---|---|
| 906867 | 3/1954 | Fed. Rep. of Germany | 123/65 BA |
| 0023317 | 1/1991 | Japan | 123/73 S |
| 2104147 | 3/1983 | United Kingdom | 123/65 BA |

*Primary Examiner*—David A. Okonsky

*Attorney, Agent, or Firm*—Pearne, Gordon, McCoy & Granger

[57] ABSTRACT

The invention relates to a more complex but considerably more emission-poor two-stroke engine than the conventional one. The HC-emissions become zero when completely burned. CO is controlled by the mixture ratio and $NO_x$ becomes very low owing to the built-in EGR.

A super charger (20) presses air through the cylinder after the power stroke and dilutes the exhaust gases. A carburettor unit (21) is fed by the super charger and presses an overrich gas mixture into the cylinder at the beginning of the compression stroke. A slide gate (22) controls the connection between the carburettor unit and the cylinder.

4 Claims, 1 Drawing Sheet

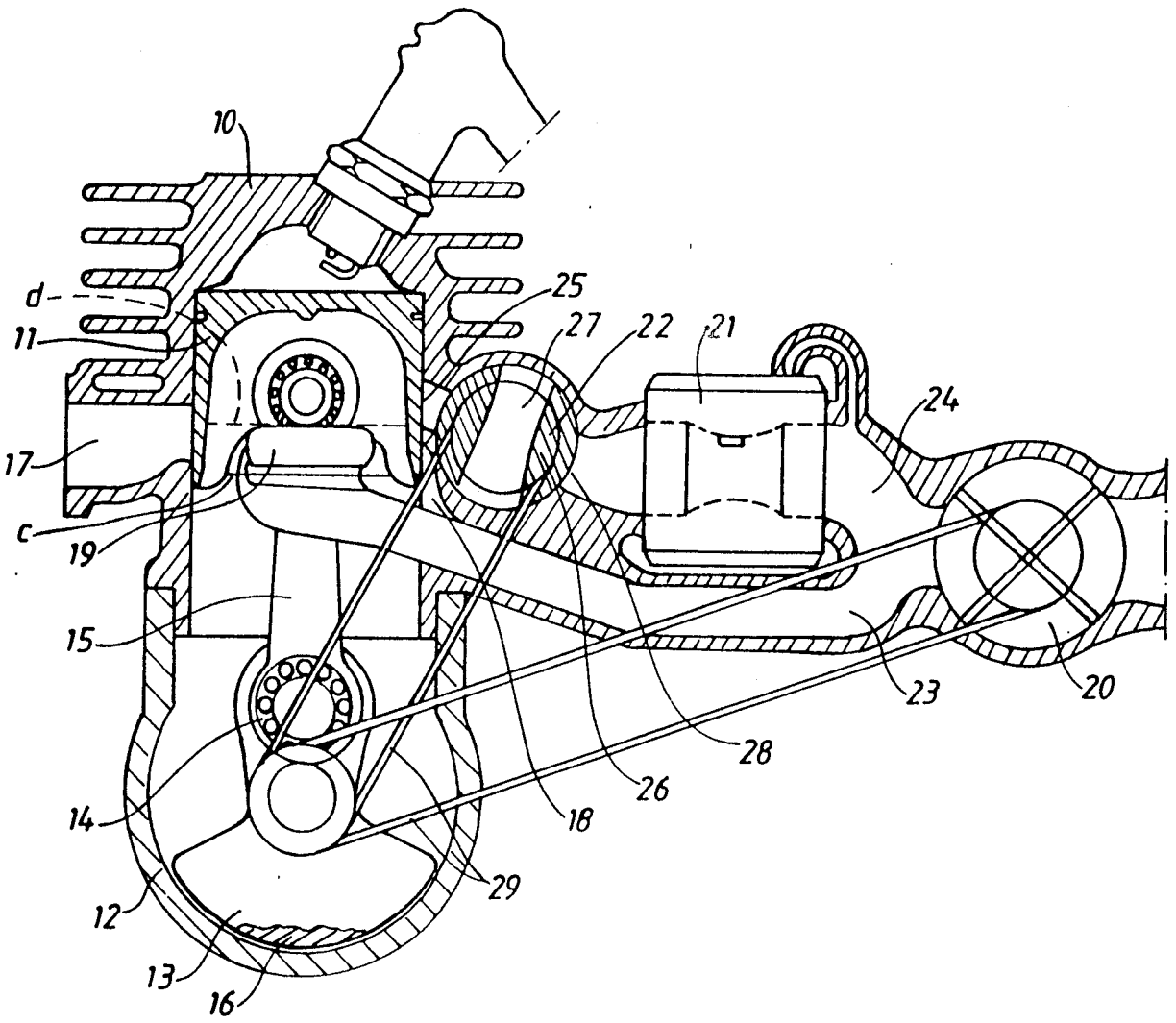
10
11
d
17
c
19
15
14
12
13
16
29
18
26
28
25
27
22
21
24
23
20

TWO-STROKE I.C. ENGINE WITH A SUPER CHARGER

The present invention relates to a two-stroke i.c. engine with a super charger on the intake side and a controlled inlet of combustion gas to the cylinder.

As to prior art in this field there are two-stroke engines with fuel injection into the combustion chamber and air inlet by means of the crankcase. A general improvement of the combustion in the engine compared to that of earlier carburettor engines has then been ascertained thanks to a better distribution and quantity determination of the fuel in the fuel/air mixture in the cylinder. Further work is going on continuously to produce cleaner engines and it has, amongst other things, been adopted as a goal that hydrocarbon compounds appearing in the exhaust gases, when the combustion is incomplete, shall disappear and that the carbon monoxide content in the exhaust is reduced to an unimportant rate at a lean fuel/air mixture, and that the nitrogen oxides by means of control by EGR (Exhaust Gas Recirculation) are depressed on the lowest level.

The present invention is a contribution to the searching for an ideal engine with a small outlet of the imputities mentioned, viz. HC, CO and $NO_x$. The basic idea is to perform an air stream through the engine that dilutes the exhaust gases and evacuates gases from the cylinder after each power stroke. As to the air stream and the exhaust gases there are arranged ports in the cylinder wall in a conventional way controlled by the piston movement. Combustible gas is fed into the cylinder through a valve-controlled port, mixed with air during the compressive stroke and ignited close to the upper end position of the piston. Such an arrangement of gas ways to the engine has the result that the goal adopted in respect of a cleaner engine will be fulfilled and the means therefore are described more in detail in the characteristics of claim 1.

An embodiment of an engine according to the invention is outlined in the following with reference to the attached drawing showing schematically a section of the engine and its gas ways.

The engine thus shown comprises only summarily the most important parts of a two-stroke engine such as cylinder 10, piston 11, crankcase 12, crankshaft 13 with a crank 14 and a connecting rod 15. In the crankcase there is an oil sump 16 containing oil for lubricating the engine. In the cylinder wall is a port of an exhaust pipe 17 as well as inlet channels 18, 19. The openings or the ports for these ones are situated above the piston which then is close to its lower end postion (continuous line c). The inlet channel comes from a super charger 20 operated by a transmission from the crankshaft. The piston opens the way for an air stream from the super charger to the cylinder and closes it when it has reached a bit upwards in the cylinder (dashed position d). The task of the air stream is to tow away the exhaust gases in the cylinder and dilute them to an inferior contamination level.

Combustible gas is produced in a carburettor unit 21 which is in contact with the cylinder via a slide gate 22. The outlet 23 of the super charger has a branching 24 to the unit where the gas is produced either in an ordinary carburettor or by means of an injection pump. The gas produced is a fat mixture of fuel and air. The port 25 in which the slide is located, is situated above the air channel as well as the exhaust port in the cylinder wall and is thus kept open longer during the upward movement of the piston. The slide is a cylindric body 26 with a transversal channel 27 that opens the connection to the cylinder when the piston is in the dashed position d. The body 26 journalled in the hollow space 28 of the cylinder casting is rotatable and operated by a transmission 29 from the crankshaft. An engine with these aggregates has the following mode of operation.

With reference to the figure the piston is going upwards. Slightly before the exhaust port is closed the slide gate opens the carburettor connection and an overrich mixture is pressed into the cylinder until the gate is closed again.

During the continued upward movement of the piston the mixture is diluted with air already existing in the cylinder. The gas is compressed and ignited by the spark plug.

During the following power stroke the gate is closed, but before the piston reaches the lower end position c, firstly the exhaust channel opens and then immediately afterwards the air channels.

Clean air is blown through the cylinder and dilutes the exhaust gases which are leaving the engine through the exhaust gas outlet.

When the piston travels upwards, firstly the air channels close and then the exhaust gas outlet. Thereby a super charging of gas in the cylinder is avoided at this stage.

The procedure is repeated in respect of each engine revolution. A condition for a good result when it comes to clean exhaust gases is the check of port times and air pressure from the super charger. Naturally there are adjustment possibilities for those parameters but such arrangements have not been included as part of the invention. The latter is, however, principally defined in the following claims.

I claim:

1. Two-stroke i.c. engine with a super charging aggregate (20) comprising an air channel (23) and a branch passage (24) from said aggregate to the cylinder of the engine, said channel and passage being opened and closed by means of the piston of the engine, and also an exhaust channel, also being opened and closed by the piston, characterized in that there is a carburetor unit (21) fed from said aggregate (20) and connected to the cylinder via said branch passage having a feed valve (22) with a determined feed period for each engine revolution taking place after closing of said air channel.

2. I.c. engine according to claim 1, characterized in that the feed valve is a slide gate operated from the engine crankshaft.

3. I.c. engine according to claim 1, characterized in that the carburetor unit contains a float carburetor or a diaphragm carburetor.

4. I.c. engine according to claim 1, characterized in that the carburetor unit contains an injection pump.

* * * * *